US006915723B2

(12) United States Patent
Hsieh

(10) Patent No.: US 6,915,723 B2
(45) Date of Patent: Jul. 12, 2005

(54) RATCHET SOCKET WRENCH

(76) Inventor: Chih-Ching Hsieh, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/418,977

(22) Filed: Apr. 18, 2003

(65) Prior Publication Data

US 2004/0206211 A1 Oct. 21, 2004

(51) Int. Cl.[7] ..... B25B 13/46
(52) U.S. Cl. ..... 81/60; 81/124.6; 81/177.85
(58) Field of Search ..... 81/60–63.2, 121.1, 81/125, 176.15, 124.6, 177.85, 461

(56) References Cited

U.S. PATENT DOCUMENTS 2,326,317 A * 8/1943 Amtsberg ..... 81/124.6
2003/0121371 A1 * 7/2003 Chiu ..... 81/63.1

* cited by examiner

*Primary Examiner*—James G. Smith

(57) ABSTRACT

A ratchet socket wrench has a main body, a shaft disposed on the main body, a drive device engaging with the shaft, and a sleeve engaging with the drive device. The drive device has a center hole, and a ratchet portion having a plurality of ratchets and an outer periphery groove. An elastic ring encloses the outer periphery groove of the drive device. A collar encloses the drive device. The sleeve has a corrugation hole, and a pawl portion having a plurality of pawls and an outer periphery recess. The pawls engage with the ratchets. The shaft is inserted in the center hole of the drive device. The collar has an inner annular flange. The drive device further has an annular recess to receive the inner annular flange of the collar.

2 Claims, 8 Drawing Sheets

RATCHET SOCKET WRENCH

BACKGROUND OF THE INVENTION

The present invention relates to a ratchet socket wrench. More particularly, the present invention relates to a ratchet socket wrench which has a collar to protect an elastic ring of a drive device.

Referring to FIG. 1, a conventional socket wrench 10 has a main body 11, a shaft 111 disposed on the main body 11, and a sleeve 12 engaging with the shaft 111. However, a torsion of the conventional socket wrench 10 is small.

Referring to FIG. 2, a conventional ratchet socket wrench 20 has a main body 21, a shaft 211 disposed on the main body 21, a drive device 22 engaging with the shaft 211, and a sleeve 23 engaging with the drive device 22. The drive device 22 has an inner chamber 221, and a ratchet portion 222 having a plurality of ratchets 222A and an outer periphery groove 222B. An elastic ring 222C encloses the outer periphery groove 222B of the drive device 22. The sleeve 23 has a round hole 232, and a pawl portion 231 having a plurality of pawls 231A and an outer periphery recess 231B. The pawls 231A engage with the ratchets 222A. The shaft 211 is inserted in the inner chamber 221 of the drive device 22. The elastic ring 222C is inserted in the outer periphery recess 231B of the sleeve 23. However, the elastic ring 222C is easily deformed while the elastic ring 222C is bumped. Furthermore, the elastic ring 222C is easily rusted.

SUMMARY OF THE INVENTION

An object of the present invention is to provide a ratchet socket wrench which has a collar to protect an elastic ring of a drive device so that the elastic ring will not be bumped and rusted.

Another object of the present invention is to provide a collar to enclose a drive device so that the collar will be engaged with the drive device stably.

Accordingly, a ratchet socket wrench comprises a main body, a shaft disposed on the main body, a drive device engaging with the shaft, and a sleeve engaging with the drive device. The drive device has a center hole, and a ratchet portion having a plurality of ratchets and an outer periphery groove. An elastic ring encloses the outer periphery groove of the drive device. A collar encloses the drive device. The sleeve has a corrugation hole, and a pawl portion having a plurality of pawls and an outer periphery recess. The pawls engage with the ratchets. The shaft is inserted in the center hole of the drive device.

In accordance with a first preferred embodiment of the present invention, a ratchet socket wrench comprises a main body, a shaft disposed on the main body, a drive device engaging with the shaft, and a sleeve engaging with the drive device. The drive device has a center hole, and a ratchet portion having a plurality of ratchets and an outer periphery groove. An elastic ring encloses the outer periphery groove of the drive device. A collar encloses the drive device. The sleeve has a corrugation hole, and a pawl portion having a plurality of pawls and an outer periphery recess. The pawls engage with the ratchets. The shaft is inserted in the center hole of the drive device. The collar has an inner annular flange. The drive device further has an annular recess to receive the inner annular flange of the collar.

In accordance with a second preferred embodiment of the present invention, a ratchet socket wrench comprises a main body, a shaft disposed on the main body, a drive device engaging with the shaft, and a sleeve engaging with the drive device. The drive device has a center hole, and a ratchet portion having a plurality of ratchets and an outer periphery groove. An elastic ring encloses the outer periphery groove of the drive device. A collar encloses the drive device. The sleeve has a corrugation hole, and a pawl portion having a plurality of pawls and an outer periphery recess. The pawls engage with the ratchets. The shaft is inserted in the center hole of the drive device. The collar has an inner thread. The drive device further has an outer thread to receive the inner thread of the collar. A ball is disposed on the shaft. The drive device further has an inner blocking bevel to click the ball.

DETAILED DESCRIPTION OF THE INVENTION

Figure 1:
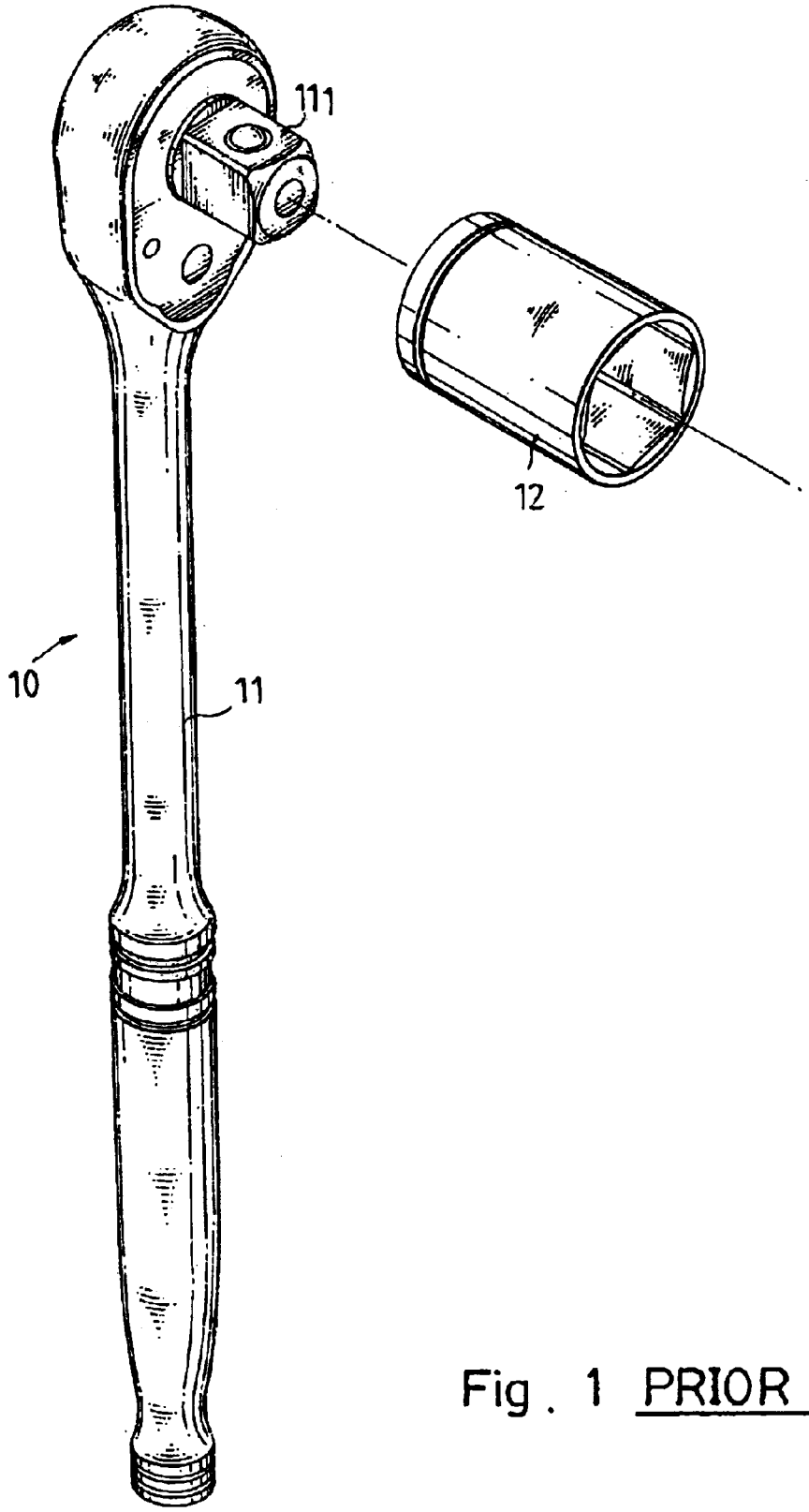
Fig. 1 PRIOR ART
FIG. 1 is a perspective exploded view of a socket wrench of the prior art.
Figure 2:
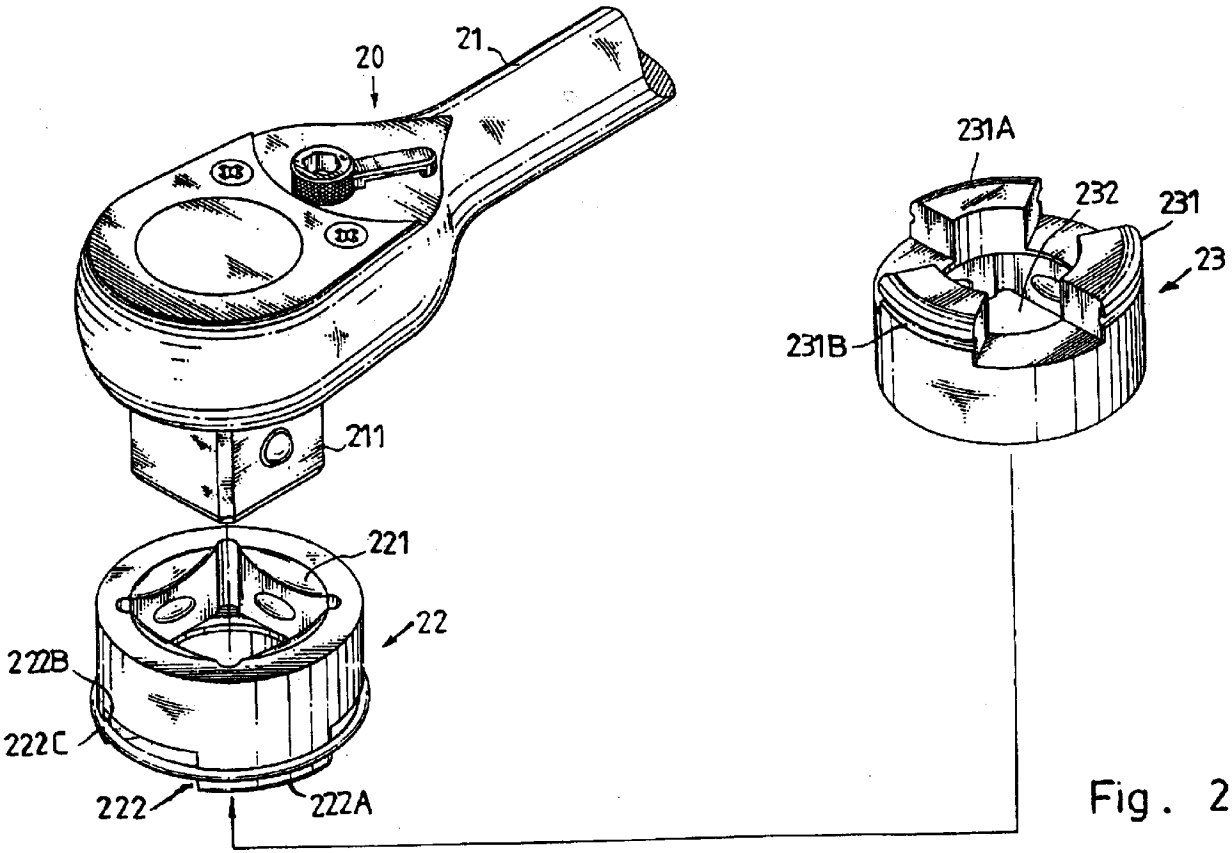
Fig. 2 PRIOR ART
FIG. 2 is a perspective exploded view of a ratchet socket wrench of the prior art.
Figure 3:
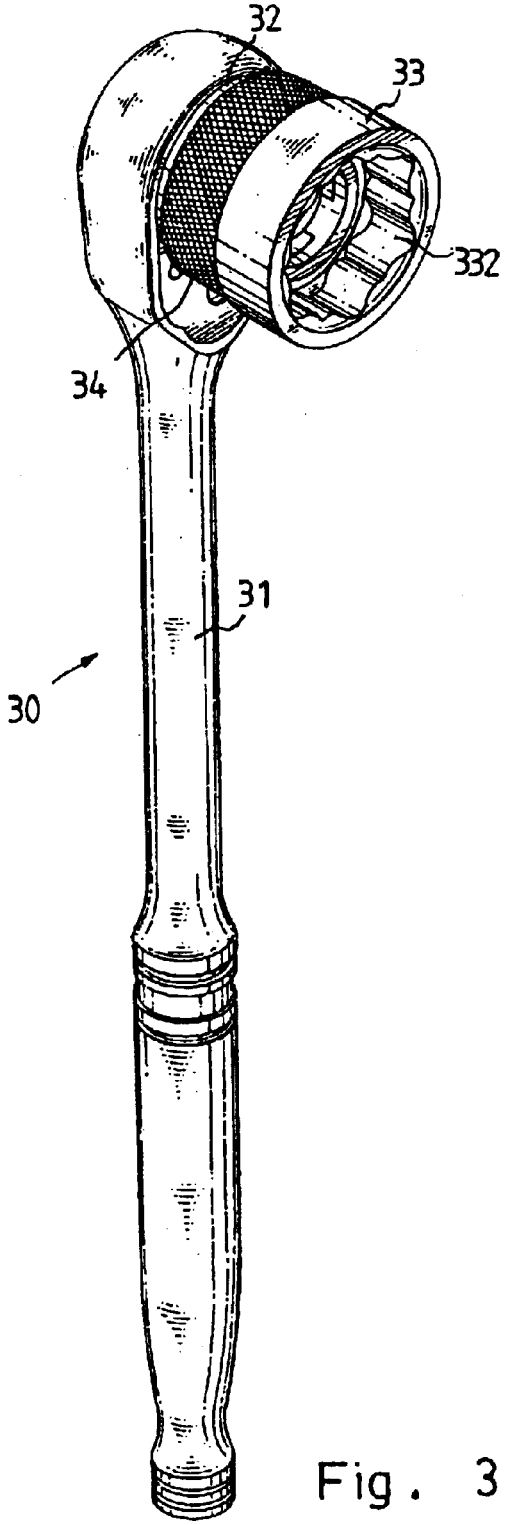
FIG. 3 is a perspective assembly view of a ratchet socket wrench of a first preferred embodiment in accordance with the present invention.
Figure 4:
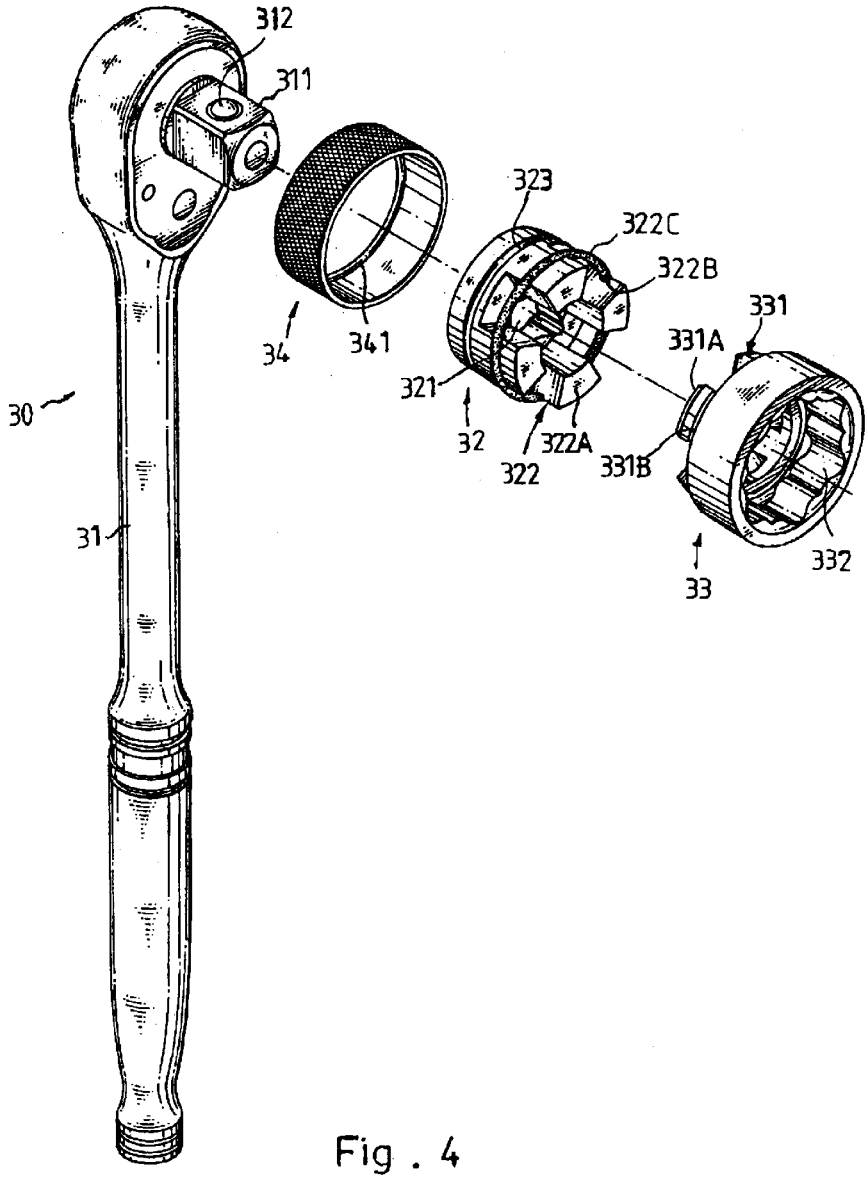
FIG. 4 is a perspective exploded view of a ratchet socket wrench of a first preferred embodiment in accordance with the present invention.
Figure 5:
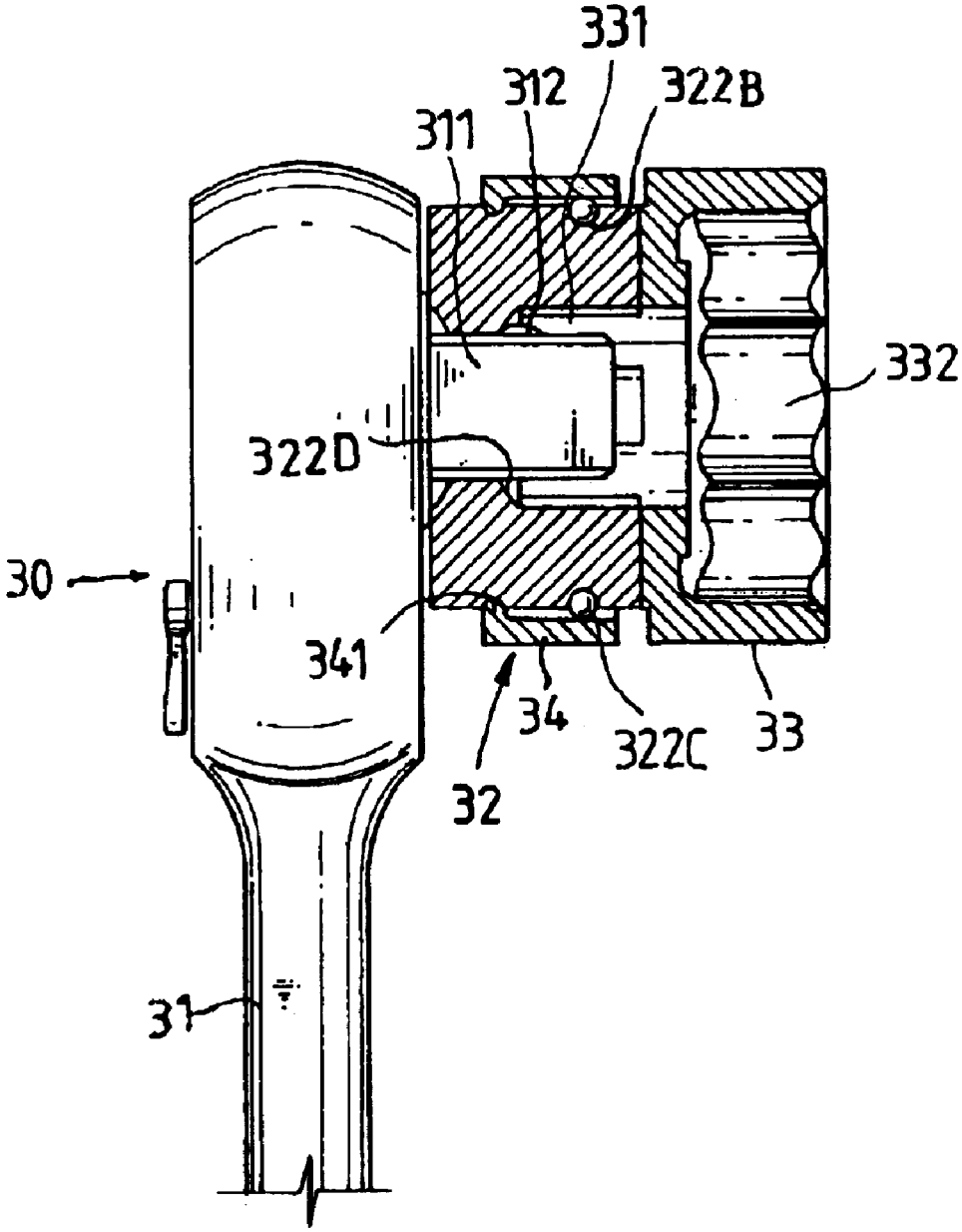
FIG. 5 is a sectional assembly view of a ratchet socket wrench of a first preferred embodiment in accordance with the present invention.
Figure 6:
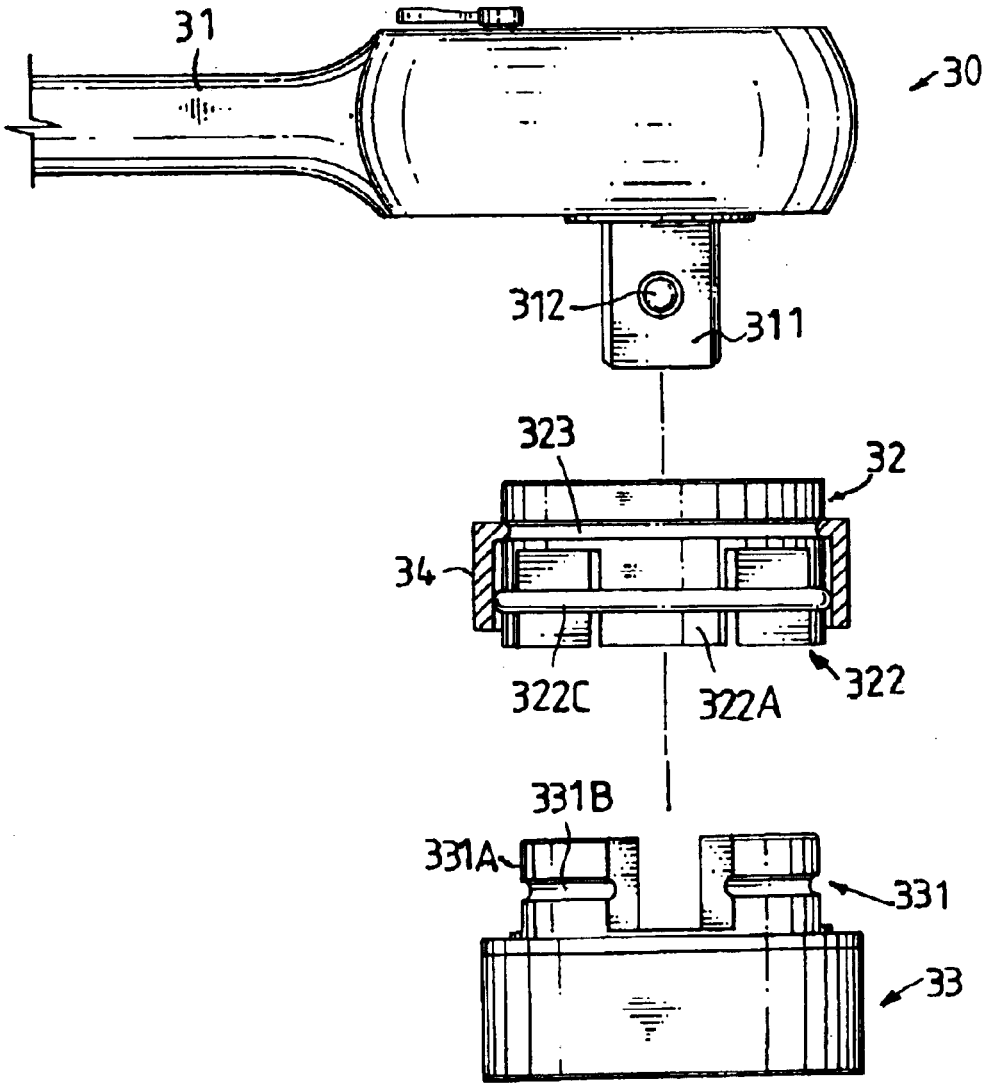
FIG. 6 is a partially sectional exploded view of a ratchet socket wrench of a first preferred embodiment in accordance with the present invention.

Referring to FIGS. 3 to 6, a first ratchet socket wrench 30 comprises a main body 31, a shaft 311 disposed on the main body 31, a drive device 32 engaging with the shaft 311, and a sleeve 33 engaging with the drive device 32. The drive device 32 has a center hole 321, and a ratchet portion 322 having a plurality of ratchets 322A and an outer periphery groove 322B. An elastic ring 322C encloses the outer periphery groove 322B of the drive device 32. A collar 34 encloses the drive device 32. The sleeve 33 has a corrugation hole 332, and a pawl portion 331 having a plurality of pawls 331A and an outer periphery recess 331B.

The pawls 331A engage with the ratchets 322A.

The shaft 311 is inserted in the center hole 321 of the drive device 32.

The collar 34 has an inner annular flange 341.

The drive device 32 further has an annular recess 323 to receive the inner annular flange 341 of the collar 34.

A ball 312 is disposed on the shaft 311.

Therefore, the collar 34 will engage with the drive device 32 stably.

It is an option to provide patterns on an outer periphery of the collar 34 so that a user will find a predetermined size of the drive device 32 will match a predetermined size of the sleeve 33 easily.

Figure 8:
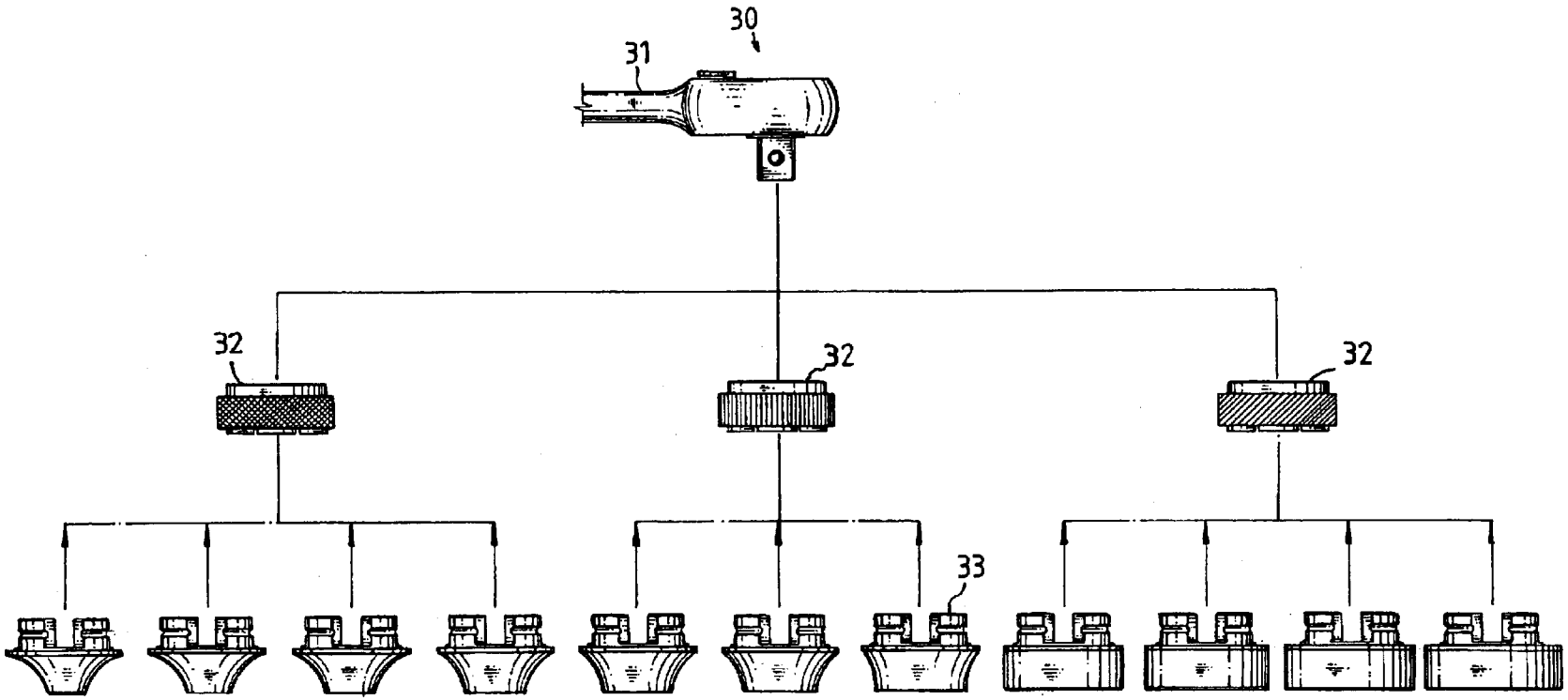
FIG. 8 is a flow chart illustrating a plurality of drive devices engaging with different kinds of sleeves.

Referring to FIG. 8, a plurality of drive devices 32 engaging with different kinds of sleeves 33 are illustrated.

Figure 7:
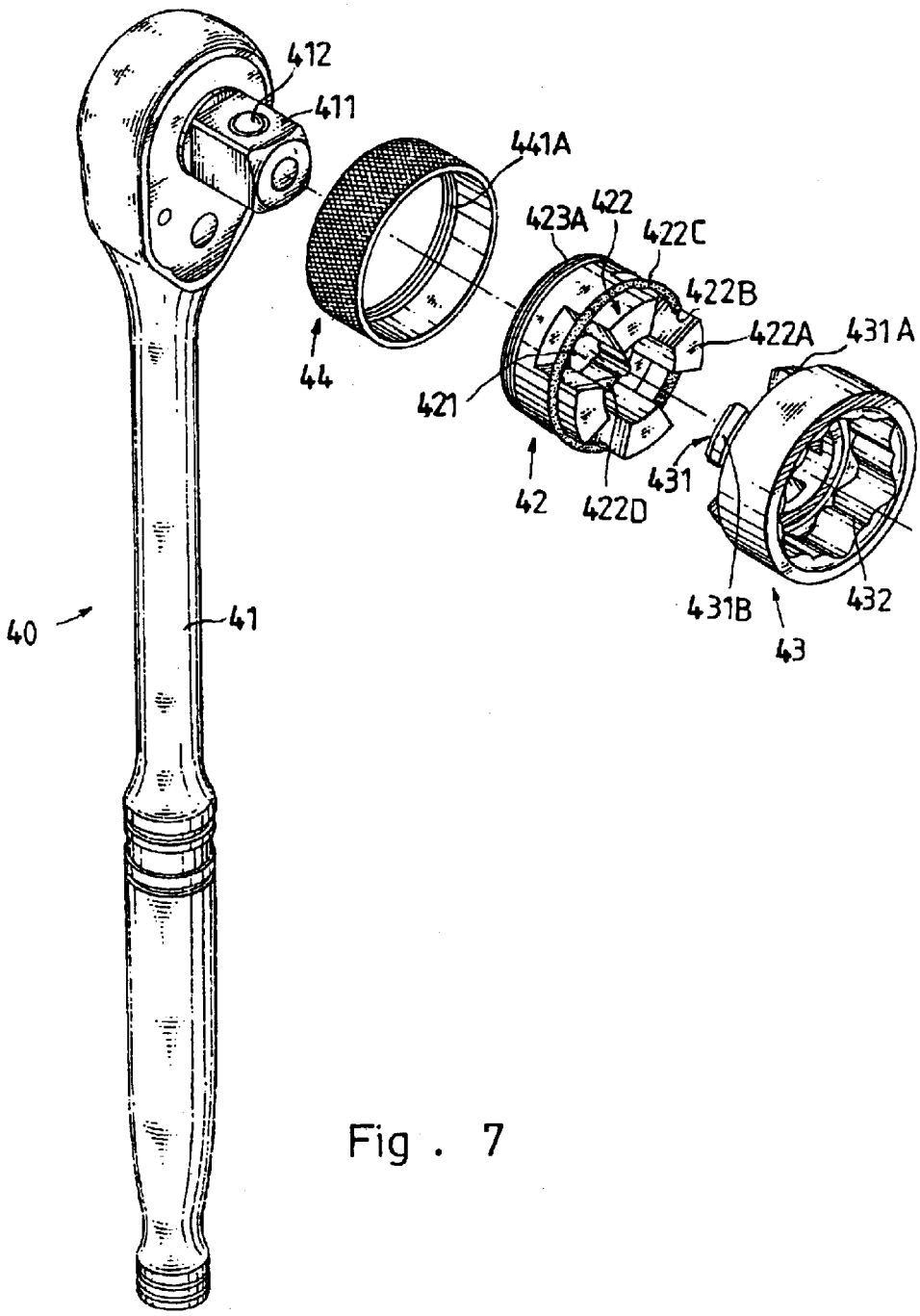
FIG. 7 is a perspective exploded view of a ratchet socket wrench of a second preferred embodiment in accordance with the present invention.

Referring to FIG. 7, a second ratchet socket wrench comprises a main body 41, a shaft 411 disposed on the main body 41, a drive device 42 engaging with the shaft 411, and a sleeve 43 engaging with the drive device 42. The drive device 42 has a center hole 421, and a ratchet portion 422 having a plurality of ratchets 422A and an outer periphery groove 422B. An elastic ring 422C encloses the outer periphery groove 422B of the drive device 42. A collar 44 encloses the drive device 42. The sleeve 43 has a corrugation hole 432, and a pawl portion 431 having a plurality of pawls 431A and an outer periphery recess 431B.

The pawls 431A engage with the ratchets 422A.

The shaft 411 is inserted in the center hole 421 of the drive device 42.

The collar 44 has an inner thread 441A.

The drive device 42 further has an outer thread 423A to receive the inner thread 441A of the collar 44.

A ball 412 is disposed on the shaft 411.

The drive device 42 further has an inner blocking bevel 422D to click the ball 412.

The center hole 421 of the drive device 42 has a rectangular shape.

The present invention has the following advantages.

The collar will cover and protect the elastic ring of the drive device so that the elastic ring will not be bumped and rusted.

The collar has the inner annular flange and the drive device has the annular recess to receive the inner annular flange of the collar so that the collar will be engaged with the drive device stably.

The collar has the inner thread and the drive device has the outer thread to receive the inner thread of the collar so that the collar will be engaged with the drive device stably.

The drive device has an inner blocking bevel to click the ball so that the ball will be positioned stably.

It is an option to provide patterns on an outer periphery of the collar so that a user will find a predetermined size of the drive device will match a predetermined size of the sleeve easily.

The present invention is not limited to the above embodiments but various modification thereof may be made. Furthermore, various changes in form and detail may be made without departing from the scope of the present invention.

I claim:

1. A ratchet socket wrench comprising:

a main body, a shaft disposed on the main body, a drive device engaging with the shaft, a sleeve engaging with the drive device, the drive device having a center hole, and a ratchet portion having a plurality of ratchets and an outer periphery groove, an elastic ring enclosing the outer periphery groove of the drive device, a collar enclosing the drive device, the sleeve having a corrugation hole, and a pawl portion having a plurality of pawls and an outer periphery recess, the pawls engaging with the ratchets, and the shaft inserted in the center hole of the drive device;

wherein the collar has an inner annular flange, and the drive device further has an annular recess to receive the inner annular flange of the collar.

2. A ratchet socket wrench comprising:

a main body, a shaft disposed on the main body, a drive device engaging with the shaft, a sleeve engaging with the drive device, the drive device having a center hole, and a ratchet portion having a plurality of ratchets and an outer periphery groove, an elastic ring enclosing the outer periphery groove of the drive device, a collar enclosing the drive device, the sleeve having a corrugation hole, and a pawl portion having a plurality of pawls and an outer periphery recess, the pawls engaging with the ratchets, and the shaft inserted in the center hole of the drive device;

wherein the collar has an inner thread and the drive device further has an outer thread to receive the inner thread of the collar.

* * * * *